United States Patent [19]

Dean et al.

[11] Patent Number: 5,038,704

[45] Date of Patent: Aug. 13, 1991

[54] STOWABLE TEMPORARY SIGNALING DEVICE FOR RAIL SYSTEMS

[76] Inventors: Thomas R. Dean, 711 Hanson Ct., Onalaska, Wis. 54650; Kenneth T. Christenson, N3498 CTH BM, La Crosse, Wis. 54602

[21] Appl. No.: 326,112

[22] Filed: Mar. 20, 1989

[51] Int. Cl.[5] ..... G09F 17/00

[52] U.S. Cl. ..... 116/173; 116/63 P; 246/477

[58] Field of Search ..... 116/63 P, 173; 246/477, 246/488, 167 A; 248/231.6; 238/338, 342

[56] References Cited

U.S. PATENT DOCUMENTS

| | | | |
|---|---|---|---|
| 269,955 | 1/1883 | Paullin | 246/477 |
| 418,155 | 12/1889 | Berry | 246/477 |
| 606,197 | 6/1898 | Dunn | 246/477 |
| 733,445 | 7/1903 | Weber | 238/338 |
| 1,297,521 | 3/1919 | Van Dresar | 246/477 |
| 1,320,380 | 11/1919 | Currie | 246/477 |
| 1,396,787 | 11/1921 | Shepard | 116/173 |
| 1,747,278 | 2/1930 | Zawyruchia | 116/173 |
| 2,072,573 | 3/1937 | Vigliotti | 116/173 |
| 2,441,875 | 5/1948 | Faber | 116/173 |
| 2,499,874 | 3/1950 | Peterson | 116/173 |

FOREIGN PATENT DOCUMENTS

| | | | |
|---|---|---|---|
| 664528 | 6/1963 | Canada | 238/342 |
| 418010 | 8/1925 | Fed. Rep. of Germany | 238/338 |
| 2712365 | 9/1978 | Fed. Rep. of Germany | 246/477 |
| 9117 | 6/1915 | United Kingdom | 246/477 |

OTHER PUBLICATIONS

*Popular Mechanics*, "Combined Taillight and Flagstaff Guards Implements on Highway", vol. 100 No. 6 p. 196, Dec. 1953.

*Primary Examiner*—William A. Cuchlinski, Jr.
*Assistant Examiner*—W. Morris Worth
*Attorney, Agent, or Firm*—M. Paul Hendrickson

[57] ABSTRACT

The present invention provides a portable, temporary railroad signaling device which may be tenaciously secured onto a railroad rail and its use. The device includes an adjustable and fixed clamping mechanism for clasping onto a railroad rail placed therewithin, which mechanism when tightly drawn together mechanically biases and wedges the rail therebetween. The device advantageously includes a collapsible arm to mount and support a signaling unit thereupon an internal housing for stowing a signaling unit therewithin and a lock for locking the clamped device onto the rail to protect the device against unauthorized tampering.

12 Claims, 3 Drawing Sheets

STOWABLE TEMPORARY SIGNALING DEVICE FOR RAIL SYSTEMS

FIELD OF THE INVENTION

The present invention relates to signaling devices and more particularly to portable rail signaling devices which may be secured onto a rail and the method of using the same.

BACKGROUND OF THE INVENTION

Signaling devices are customarily used to forewarn locomotive operators of men and equipment working, unsafe rail or track conditions. Electronic signal devices are commonly used at certain selected and accessible sites for this purpose. These electronic devices are costly to install and maintain. Consequently, track portions within some rail systems remain unserviced by signaling devices. Unfortunately, these sophisticated signal systems can not warn approaching trains or temporary speed restrictions, men and equipment working on or about the tracks and conditions unsafe for traffic.

Accidental, vandalism, wear and attrition, climatic, geological and other mechanical rail failure sources frequently create hazardous or unsafe rail conditions. Since substantial time and distances are required to stop trains, governmental regulations mandate that temporary warning devices be appropriately positioned along the track at appropriate times and emergencies to inform and instruct the operating personnel of such unsafe or hazardous conditions ahead. A conventional flagging device typically includes a base portion which either simply rests upon the ground surface or is adapted to be driven into the ground along the track siding which supports a signaling flag and the flag bearing staff or staffs. These flagging devices are frequently installed at remote and unattended sites.

Notwithstanding the use of these mandated devices for several decades, a number of inherent defects and problems have arisen through the use of these flagging devices. Since railroad operating personnel must necessarily rely upon such temporary flagging devices, it is of paramount importance that these devices remain intact throughout the entire duration of their intended use. A particular troublesome problem involves the inability to maintain these temporary devices in proper flagging position. Environmental conditions (e.g. flooding, wind, animals, erosion, earthquakes, land slides, wash outs, etc.), human factors (e.g. vandalism, theft, etc.) and other natural and/or unnatural factors can readily dislodge such devices from their original setting. The problem is further compounded by the fact that the device must be sufficiently compact in size so as to permit its portability to the desired site. This places limitations upon the supportive structure for maintaining an appropriate flagging position. The preferred temporary flagging devices are simply driven into the ground. Unfortunately, trackway is often laiden with rocks, uneven and sloping shoulders or frozen which makes it difficult, if not impossible, to achieve the appropriate supportive footing or grounding of the device onto the track site. Notwithstanding a long felt need for a safer, more secure, tamper-proof, portable and stowable flagging device, the over-all design and structure of these devices have remained essentially unchanged.

U.S. Pat. No. 1,747,278 to Zawyrachia discloses a detachable flag signaling device adapted for securance onto a rail. This device includes a flat metal base designed to slide beneath the rail, an upwardly projecting and fixed hooked or flanged section positioned at a terminal end of the base which hooks over and rests onto one of the upper edges of the rail base, an oppositely adjustable flanged or hooked member (which may be manually slid along the metal base section so as to hook onto upper opposite edge of the rail base) fitted with a set screw to tighten the manually adjusted flanged member onto the base. The rail engaging portions of this signaling device relies upon the flanged areas which primarily hang or rest upon the top edges of the rail base. The device is not designed to rigidly secure onto the rail and therefore is susceptible to dislocation along the rail base or by loosening of the set screw. Although this device had been known for more than a half-century, it has neither been extensively used nor considered suitable for adaptation to modern day railroads. The device is of a lightweight construction without affording sufficient means for rigidly securing it onto the rail. Accordingly, it fails to include protective safeguards against unauthorized or unintentional dislocation of the device from the rail. This device incorporates a system that houses three different signaling flags which when displayed could easily be altered (such as by vandalism, human error or other unnatural causes) to project a different flag other than the one intended. The over-all means for securing the Zawyrachia device onto the rail prevents it from effective adaptation to a modern rail system. If unattended, the Zawyrachia device would be readily prone to displacement by factors inherently arising out of and caused by modern day rail systems. This may be exemplified by the fact that older rail systems primarily relied upon relatively short rail spans firmly secured onto the railroad ties and firm or solid rail bed. The older tracks were designed to support relatively light car loads carried upon railroad cars of a short wheel base. In contrast, modern day trackage utilize continuous welded tracks of extremely long lengths designed for railroad cars having a substantially greater weight bearing capacity and longer wheel bases. Correspondly, the axle pressure created at the wheel contact interface onto the rail is considerably greater than that encountered under the older systems. The modern day tracks are thus subjected to considerably more flexing and vertical movement (e.g. floating) than encountered under the older systems. Comparatively, modern trackage upon passage of a train will thus undergo a significantly higher order of stress, impact, attrition, wear and tear than the older rail systems. Track engaging components which are not structured or designed to withstand such strenuous tracking conditions as created by modern day rail systems are thus inherently susceptible to mechanical failure. Poorly or loosely fitting track engaging components (e.g. such as disclosed by Zawyrachia) become especially susceptible to mechanical fatigue and failure within the passage of a few trains thereupon. Many early mechanical devices suitable for adaptation to the older rail systems (e.g. such as the device disclosed by Zawyrachia) are thus inherently unsuited for adaptation to a modern rail system.

Several references have disclosed various modified forms of flag holding devices. U.S. Pat. No. 2,441,875 to Faber discloses an extensible and collapsible flag holder which include a tubular open-ended member capable of retaining a rolled-up trainman's safety signal flag. U.S. Pat. No. 2,499,874 to Peterson discloses a holder with a rolled-up signal flag for planting along the right of way of railroads, which comprises a hollow cylindrical flag housing section and a smaller diameter rod section fitted with an anchoring rod end. The holder has an apertured cross bar for securing it to a wall or the like. U.S. Pat. No. 1,396,787 to Shepard discloses a signal flag comprised of a handle having a spiral groove, a sleeve slidably mounted upon the handle, a pin carried by the sleeve and movable within said groove, means for holding the sleeve fixed upon the handle at the limit of movement in either direction, and a connection between the sleeve and flag for holding it taunt in its extended position.

The temporary railroad signaling devices have remained essentially unchanged over the past several decade, notwithstanding a need for more reliable, tamper-proof, safer and portable flagging device. This need is accentuated by the substantial operating personnel reductions which have occured within the railroad industry within recent years. Regional division centers and maintenance crews (as opposed to local roadmasters and crews) currently bear the primary responsibility for servicing vast territories within a particular railroad system. A compact, stowable flagging devices which could be expeditiously transported and installed at a remote site and which would permanently remain at the site as originally installed until removed by the railroad personnel would afford definitive safety and economical advantages.

SUMMARY OF THE INVENTION

The inventors, cognizant of these unfulfilled needs, have invented a temporary flagging device which would meet the prerequisitial attributes currently needed by modern day railroad systems. This development resulted in an improved temporary flagging device designed and constructed so as to withstand the rigorous abuses typically encountered within modern rail systems while also affording a compact and foldable construction which could easily be stowed, transported and installed at its intended site of use. The device also affords a superior encasement for protectively stowing signals therewithin without sacrificing an ability to expeditiously erect the device at the temporary flagging site. The device includes means for firmly biasing the device onto modern day rail in such a manner so that it will effectively maintain the device at the proper flagging position throughout the duration of its intended use. The design, construction and cooperative interrelationship of the signaling device components with existing rail systems substantially reduces the potential risks of mechanical damage or operational failure. The device advantageously incorporates an effective means for securely locking the erected device onto the rail in the proper flagging position so as to further protect the installed device against vandalism, theft or other unauthorized trespass. The improved device affords substantial cost and labor savings while also providing a more reliable and safer temporary signaling device for the railroad industry.

DESCRIPTION AND PREFERRED EMBODIMENTS OF THE INVENTION

The signaling device of this invention may be more fully appreciated by referring to the accompanying drawings.

According to the present invention, there is provided a stowable railroad signaling device (generally designated as 1) which device may be temporarily erected onto a rail base (A) for purposes of notifying railway personnel of rail conditions, said signaling device 1 comprising:

(a) an elongated supportive base member 20;

(b) a rigid rim section 30 extending upwardly from said base member 20 for engagement and registration onto a first shoulder portion of a rail base;

(c) an adjustable rail engaging member 40 for lateral engagement onto a second shoulder portion of said rail base at a juxtaposition opposite to the first shoulder portion engagable by said rim section 30; and (d) mechanical means (generally designated as 50) for applying a radial biasing force onto the adjustable rail engaging member 40 in cooperative association with said base member 20 and said rigid rim section 30 so as to securely wedge the device onto the rail.

Figure 1:
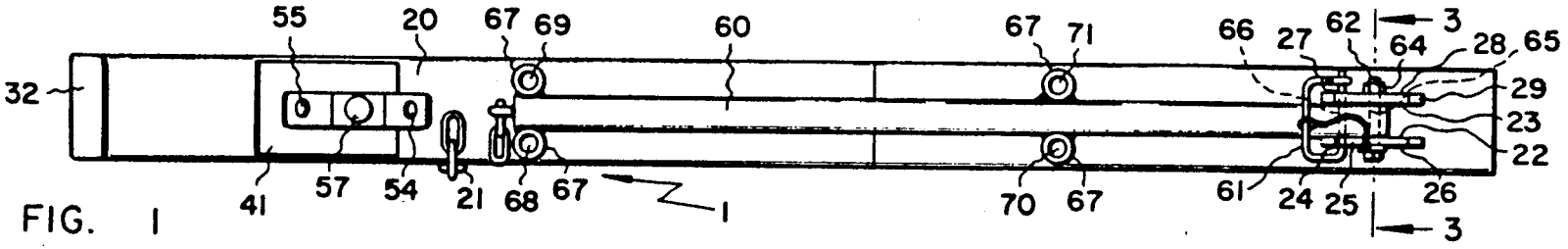
FIG. 1 discloses a top view of the signaling device of this invention.

The embodiments of the temporary flagging device 1 shown in FIG. 1, more particularly reveals (a) a horizontal main beam section 20; (b) a flanged hooked member 30 projecting upwardly from said beam section 20 for matingly engaging onto a first side of a railroad rail base A; (c) an adjustable rail engaging member 40 for operative engagement onto an opposing side of a railroad rail base A from said hooked member 30; (d) mechanical means (generally designated as 50) for firmly biasing the base of the rail between said adjustable rail engaging member onto the flanged hooked member; and (e) a signaling unit (generally designated as 60) for securance onto the device 1 to forewarn personnel of rail conditions.

The cooperative interrelationship between the rail engaging rim section 30, the adjustable rail engaging member 40, the elongated base member 20 and the mechanical means for radially biasing an interposed rail section therebetween typically requires that the structural segment of elongated base member interposed therebetween (as well as the remaining rail engaging components thereof) possess sufficient structural strength and rigidity to permit a biasing force in excess of 50 PSI to be exerted upon these component parts.

Advantageously, these cooperative components will possess sufficient structural strength to withstand biasing forces of at least 100 PSI (e.g. about 100 PSI to about 50 or more) and preferably of at least 200 PSI or more. These components are preferably of a metal construction (e.g. steel, iron, aluminum and the like), although other materials of comparable durable and high strength construction such as high impact strength thermoplastics and thermosets may also be used for this purpose.

Figure 2:
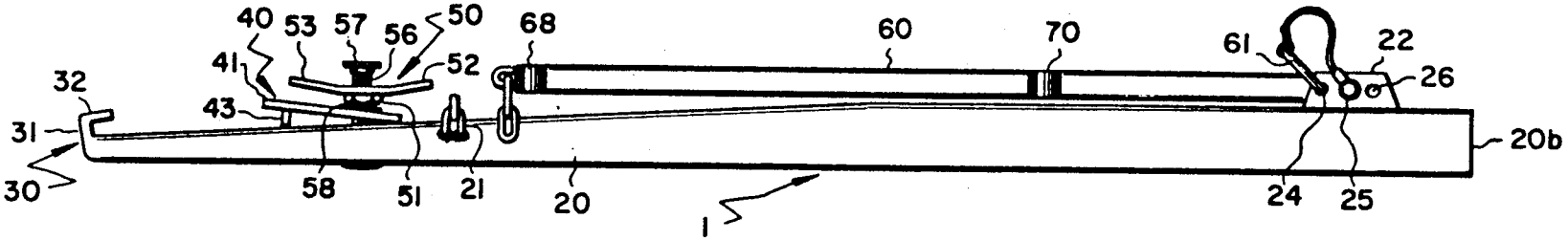
FIG. 2 shows a side view of the signaling device in FIG. 1.
Figure 3:
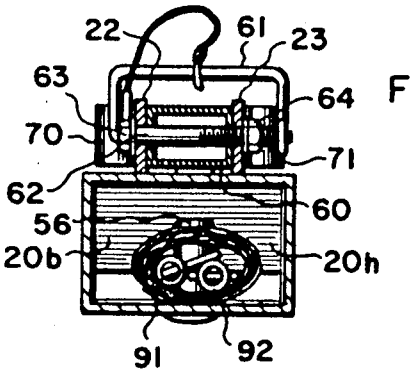
FIG. 3 is a cross-sectional view of the FIG. 2 device taken along line 3—3.

As will be observed from FIGS. 1-3, the elongated base member 2 may suitably include a hollow housing 20*b* with an access port at one end of the base member for the stowing of flags therewithin.

Figure 4:
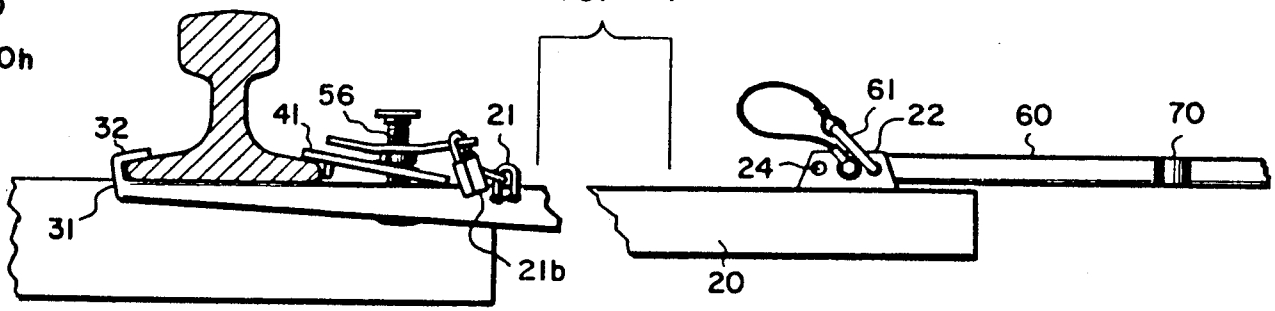
FIG. 4 is a cut-away view of the device shown in FIG. 2 with the device being further depicted therein as being secured onto a cross-sectional railroad section and the signal support standard thereto operationally extending outwardly therefrom.
Figure 6:
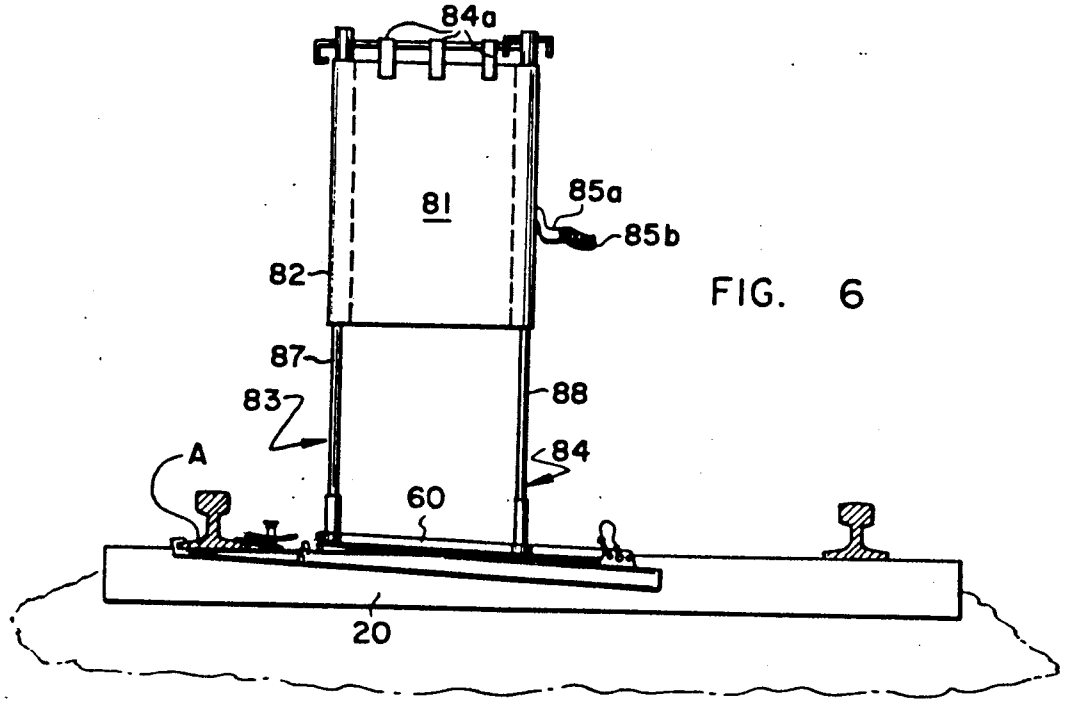
FIG. 6 is a side view of the signaling device in which the signaling portion thereof is shown as being disposed between the cross-sectional view of the railroad track.

With particular reference to FIG. 2, it will be observed that the elongated base 20 tapers to a substantially narrower width in juxtaposition to the rim section 30. This facilitates its emplacement onto rail base as illustrated in FIG. 3. The illustrated rim section 30 of FIGS. 2, 4 and 6-7 depicts a hooked-shape member of a sufficient size to secure onto the outer rail shoulder of the rail base A. The particular hooked rim section 30 depicted therein engages about 3 inches of rail base A and includes a slotted aperture measuring about ½" across on the open end and recessed by a depth of ¾" which aperture is formed by an upwardly extending rim section 31 and an inwardly projecting lip section 32 which matingly engages onto the interfacing rail base surfaces as illustrated in FIGS. 4 and 6. The rail engaging rim section 30 may be directly welded onto or otherwise firmly secured onto the elongated base member 20 so as to provide a firm and rigid anchor for the biasing of the rail base A therebetween.

The rim section 30 in combination with the elongated base member 20 provides a means for firmly anchoring one side of rail base A onto the device 1 against which the adjustable rail member 40 may firmly bias the base of the rail therebetween. The adjustable rail retaining member 40 in cooperative association with the rail engaging rim section 30 and the elongated base member 20 enables a mechanical means for applying a radially biasing force onto the rail base A (generally designated as 50) and securely wedge the rail engaging components onto the rail.

The adjustable rail engaging member 40 may similarly be of a configuration which similarly engages onto an opposing shoulder portion of rail base (e.g. the sidwall and upper rail base surface area) opposite from the engagement thereof by rail engaging rim section 30. The adjustable rail engaging member 40 as disclosed in greater detail in the Figures includes a slotted rail retaining plate 41 fitted with a centrally disposed slotted aperture 42 and rail base retaining unit 43 recessed sufficiently from the leading edge of plate 41 so as to provide recessed anchoring site for interfacial engagement onto the opposite sidewall and upper surfaces of the rail base from the rim section 30. Upon securance of the rim section 30 onto the first rail base side, adjustment of rail engaging member 40 may be effectuated simply by sliding retaining plate 41 towards the opposing rail base side until sidewall retaining unit 43 abuttingly rests flushly against the opposing shoulder portion of the rail base A. As will be further observed by the illustration shown in FIG. 4, the adjustable rail retaining member 40 in relationship to elongated base member 20 and the rail base A bottom projects radially upwardly from its contacting point onto the elongated base 20 to its interfacially contacting point to rail base A. The spacial interrelationship between the rail base A, rail base supportive elongated member 20 and biasing means 50 creates a radially biasing effect whereby the rail engaging components of engaging member 40 apply an inwardly and downwardly force onto the rail base A (principally upon the shouldered edged of the rail base) which in turn, firmly wedges and secures the rail base A to device 1.

The specific device 1 illustrated in the accompanying drawings relies upon a wing nut (generally designated as 51) and bolt 56 combination for applying the mechanical biasing force onto the rail base A to radially bias and wedge the rail base A therebetween. This may be effectuated by firmly securing a threaded bolt 56 at a centrally disposed and vertically extending position upon the elongated base member 20 in such a manner that it will remain in a fixed position and not rotate therewithin (e.g. welded thereto, carriage bolt mating onto the slotted aperture 42, etc.) when wing nut 51 is tightly drawn against the slotted retaining plate 41. The bolt 56 may be appropriately placed in an upright extending position in relationship to the elongated base 20 so as to permit a radially biasing force to be thus applied against plate 41. In the drawings, bolt 56 projects in a perpendicular relationship to the bottom surface of the elongated base 20 and has been directly welded thereto to prevent its rotation as well as potential loss or disengagement therefrom. The size of bolt 56 is sufficient to afford adequate clearance for tightening of wing nut 51 onto retaining washer 58 to bias engaging member 40 against the rail base A. The terminal projecting end of bolt 56 may provided with a wing nut stop section 57.

The wing nut 51 as depicted in the Figures, includes a pair of extended wings (52 and 53) of sufficient size and strength to forceably bias the wing nut 51 firmly against the retaining washer 58, plate 41 and onto the rail base. The wing nut 51 as depicted in the Figures, is thus provided with internal leveraging means for firmly tightening it to a sufficient biasing force to firmly wedge the rail base A within device 1. Although a single wing unit or a nut to which a wrench or other mechanical tools for tightly biasing the nut against the retaining washer may be used for this purpose, the biasing means preferably include winged nut leveraging members 52 and 53 (advantageously each measuring at least one inch from the threaded aperture of nut and preferably at least 2 inches) which radially project and extend outwardly in opposing directions from the nut 51.

In the preferred embodiments of the invention, the winged leveraging extensions are also provided with cooperative means for immobilizing and locking the nut 51 at its baising position. This embodiment is illustrated in the Figures by the padlock receiving apertures 54 and 55 of leveraging members 52 and 53. A retaining chain 21 of sufficient length secured onto elongated base 20 so as to extend to the locking apertures 54 and 55 of the wing nut 51 in combination with a conventional padlock 21*b* affords a means for securely locking and retaining the wing nut 51 in a tamper-proof position.

The elongated base includes a pair of mounting braces 22 and 23 to which the flag support arm 60 is secured. Mounting braces 22 and 23 are spaced at a sufficient distance apart to receive and support therewithin flag support arm 60. In the particular embodiments depicted in the Figures, braces 22 and 23 are centrally and laterally disposed in a parallel relationship at the distal end opposite from the rail engaging components onto the upper surface of elongated base 20.

Braces 22 and 23 may, if desired, be appropriately fabricated from flat metal sheet stock and welded directly onto the elongated base 20. Each of the braces 22 and 23 are respectively provided with three paired laterally registering apertures 24, 25, 26, 27, 28 and 29. The centrally disposed pair of registering apertures 25 and 28 afford a pivotal mount for arm 60 with registering apertures 24 and 27 and 26 and 29 respectively serving as a latching pin apertures for the arm 60 in retracted and fully extended position. A shaft 62 (shown as a threaded arm bolt 63 secured thereto by a threaded arm nut 64) secured onto brace mounts 22 and 23 respectively through brace apertures 25 and 28 secures arm 60 onto mounts 22 and 23 and permits the arm to pivotally swing thereabout.

The support arm 60 includes means for its adjustment to multiple flagging positions and stowage in a compacted form. The support arm 60 is correspondly equipped with a registering pair of arm apertures 65 and 66 which laterally extend through arm 60. Arm aperture 65 is adapted to correspondly register with the pivotal apertures 25 and 28 of braces 22 and 23 which in combination with pivotal arm mounting bolt 63 permits arm 60 to pivotally swing therefrom about a 180 degree arc. The latch pin aperture 66 of arm 60 is spaced at sufficient equidistant spacing from the pivotal aperture 65 so as to bear corresponding registration onto either brace apertures 24 and 27 or 26 and 29. The removable latch pin 61 may accordingly be inserted into the appropriate position so as to latch the arm in the extended or retracted position as respectively illustrated in FIGS. 1 and 4.

The support arm 60 is thus correspondly equipped with a pair of arm apertures 65 and 66. Arm aperture 65 is adapted to correspondly register with the pivotal aperture 25 of brace mounts 22 and 23 which in combination with pivotal mounting bolt 62 permit arm 60 to pivotally swing throughout a 180 degree arc. The latch pin aperture 66 of arm 60 is spaced at sufficient distance from the pivotal aperture 25 so as to bear corresponding registration onto brace apertures 24 and 26. A removable latch pin 61 may be accordingly inserted into the appropriate mating position so as to latch the arm in the extended or retracted lock as respectively illustrated in FIGS. 1 and 4.

The signaling support arm is further equipped with signaling unit mounts (generally designated as 67) for the mounting of signaling unit (generally designated as 80) in the signaling position. The signaling unit mount 67 illustrated in the Figures comprises 4 standard pipe couplers (designated as 68, 69, 70 and 71) measuring 1¼" and ⅜" I.D. welded directly onto signaling support arm 60 and spaced apart sufficient to receive and mountably retain the signaling unit 80 therewithin.

Figure 5:
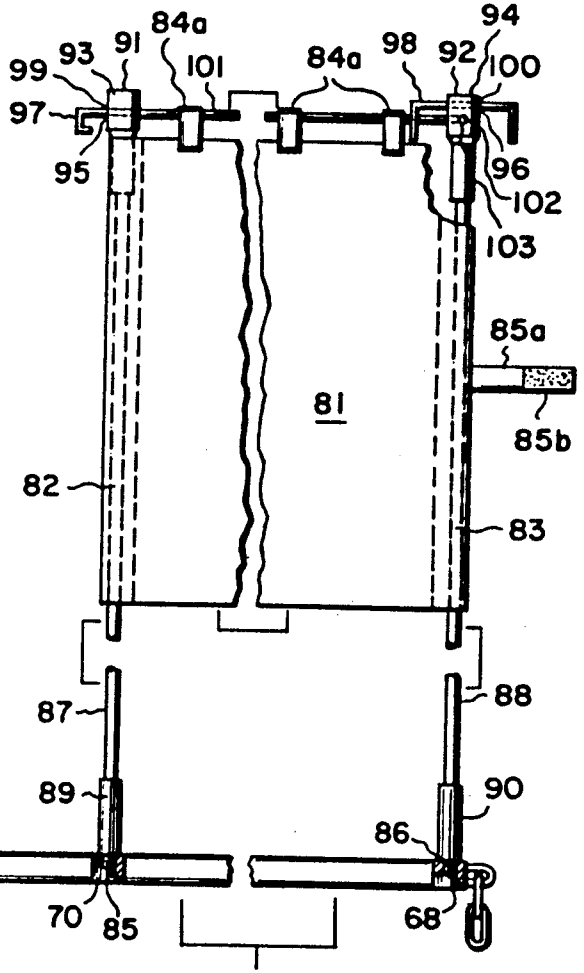
FIG. 5 is a side view of the signaling portion of the device which depicts the signaling portion thereof in a fully extended position.
Figure 7:
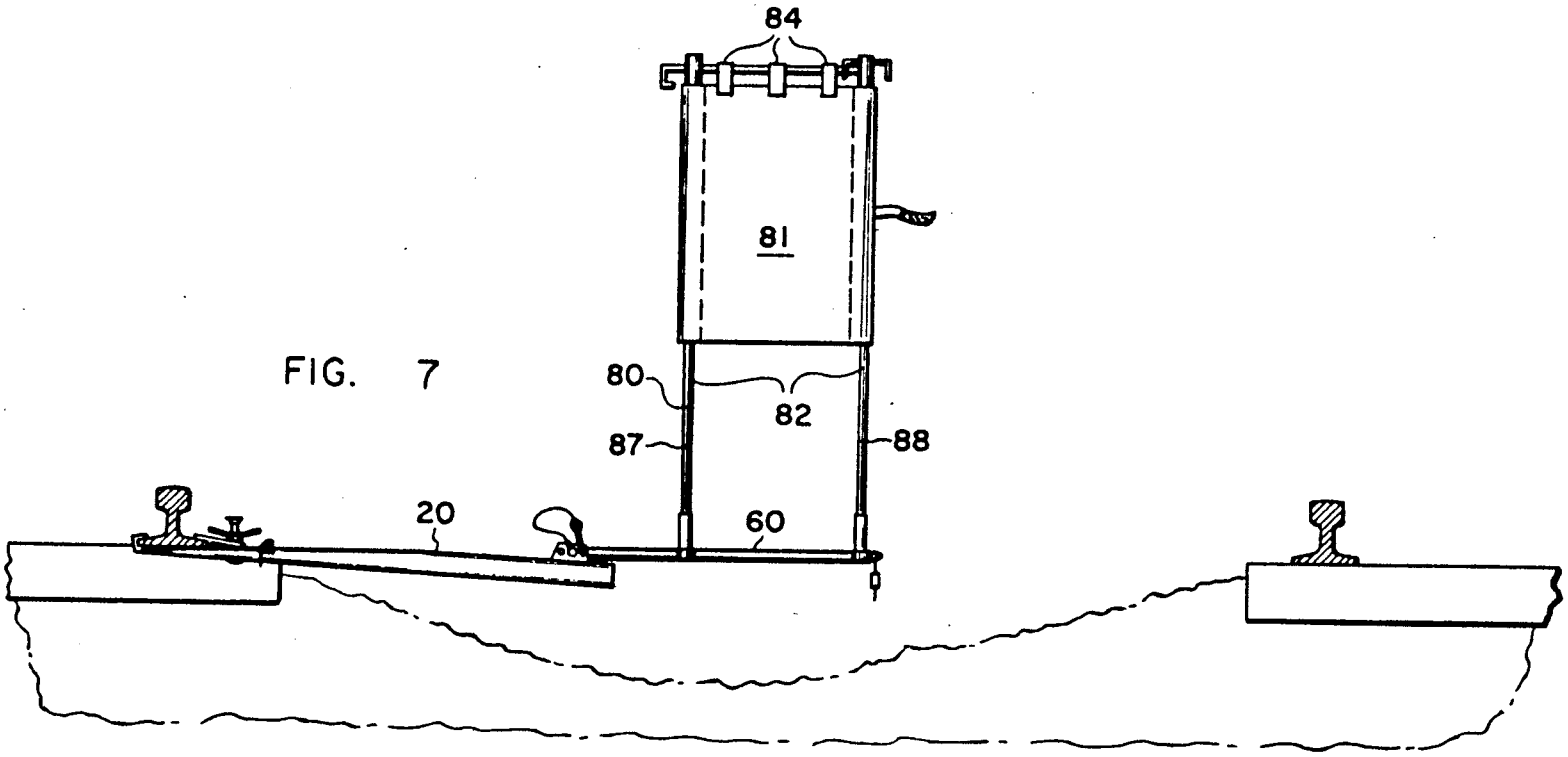
FIG. 7 shows a side view of the signaling device secured onto a rail cross-section with the flagging device thereof being shown therein as disposed between adjacently positioned railroad trackways.
Figure 8:
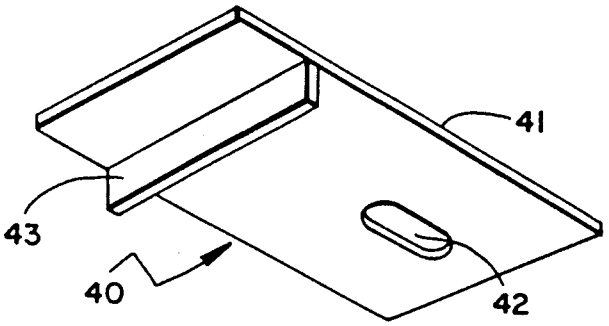
FIG. 8 is an elevational side view showing in greater detail the adjustable rail engaging component shown in FIG. 1.

The signaling unit 80, as depicted in FIGS. 5-7 is equipped with a signaling flag member 81 and a staff support unit generally designated as 82. More specifically the staff unit 82 comprises a pair of flagging staffs 83 and 84 respectively fitted with threaded male units 85 and 86 at the staff base for correspondent registration and threading onto pipe couplers 68 and 70. Couplers 69 and 71 may be used to display another flag facing the opposite direction if need would arise. The threaded couplers are also open to threading from the top or bottom side and therefore may be used as flag staff mounts in the extended or retracted positions as respectively depicted in FIGS. 5 and 6. The main staffs 87 and 88 may advantageously be constructed of flexible material such as a fiberglass rods so as to permit the staffs to bend without breaking or permanent bending. The threaded male units 85 and 86 may be coupled onto the staffs 87 and 88 by rubber tubing 89 and 90 of an I.D. for mating registration onto male units 85 and 86. The rubber tubing 89 and 90 may, if desired, be respectively cemented together onto male units 85 and 86 and staffs 87 and 88 to provide a more secure bonding therebetween. The use of such flexible materials such as rubber tubing and fiberglass rodding imparts flexibility to signaling unit 80 further protects the staffs against permanent damange (e.g. bending, breaking, etc.) such as may be caused by severe winds, snow, impacting, etc. The projecting terminal ends of staffs 87 and 88 are equipped with tightening adapters 91 and 92 which facilitate the threading and mounting of male units 85 and 86 onto female couplers 68, 69, 70 and 71. The particularly tightening adapters depicted in FIGS. 5-7 were fabricated from open ended cylindrical base couplers 91 and 92 of a mating I.D. with staffs 87 and 88 crimped directly onto staffs 87 and 88 and cemented thereto to provide a firm bonding therebetween and thus prevent adapters 91 and 92 from turning or twisting upon the staffs 87 and 88 when tightened onto couplers 68, 69, 70 and 71. The head sections 93 and 94 of adapters 91 and 92 are each provided with tightening receiving apertures 95 and 96 within which there is fitted a pivotally mounted J-shaped fastening levers 97 and 98 which when pivoted to a perpendicular position to the major longitudinal axis of staffs 87 and 88 functions as a leveraged tool for the threading and securing of the staffs 87 and 88 into couplers 68, 69, 70 and 71. In addition, the illustrated head sections 93 and 94 are further provided with a pair of staff tightening apertures 99 and 100 one or both of which may be adapted to receive and support a horizontally extending top flag support rod 101 fitted with a terminal ball 102 for insertion (in the erected position) into a ball receiving socket 103.

The signaling unit as illustrated in FIGS. 5-7 may be comprised of a reflectorized flag 81, fitted with a pair of staff housing sleeves 82 and 83 which respectively extend vertically along the outer periphery of the reflecterized flag 81 which sleeves serve as a housing for staffs 87 and 88. Sleeves 82 and 83 are of a size sufficient to permit staffs 87 and 88 to be internally disposed and housed therewithin with adequate clearance to enable staffs 87 and 88 to be pivotally tightened or loosened from couplers 68, 69, 70 and 71. The reflecterized flag 81 is of sufficient surface area to comply with the regulating agency requirements and may further fitted with means (generally designated as 84) for securing flag 81 onto a flat top support rod 101 which horizontally bridges staffs 87 and 88 along the top or uppermost margins of the flag 81. The securing means 84 (as illustrated in FIGS. 5-7) may comprise a frayed projecting tab 84A and a nap (e.g. VELCRO) along the upper flag 81 margin which affords an attachable and detachable mount for securing and holding the flag 81 onto top brace 101. The flagging unit 82 may also be equipped with a VELCRO frayed projecting tab 85A and nap 85B combination along the oppossing margins of the vertical margin of the flag 81 for securing flag 81 onto the staffs in a rolled form for stowing within housing 21 and unflured by detachment of tab 85A and unrolling of the flag 81 from staffs 87 or 88.

The metal components of the device were manufactured from raw steel stock materials cut to the appropriate dimensional size. In general, all of the metal cuts were ground to a smooth edge (e.g. via a 35 grit stone) so as to remove any burrs and sharp edges therefrom. An industrial welder equipped with an automatic welding rod feeder and a 35 thousands steel welding rod was used to weld together the welded component parts of the device.

The main support portion of the elongated base member 20 was constructed of rectangular tubular steel stock measuring 1/16" thick by 2" across the two outer sidewalls by 3" width for the top and bottom walls and 42" in length. The beveled portion of the elongated member 20 which tapers downwardly towards the rim section 30 was made by cutting two triangular sections at cutting point 24" removed and in opposite direction from the access port 20B. A Plasmar Arc was used for cutting. The initial cut was along ech of the cornered edges between sidewalls and the top wall of the tubular stock from the cutting point to the cornered edge end. Then a 5 degree slope in a straight line from the cutting point a sloped cut was made in each of the sidewalls so as to leave a ⅝" sidewall flanged sidewall projection at the terminating end of the cut of both sidewalls. The resultant acute angle cuts yielded two wedged shaped pieces (measuring 24" in length, 0" at the respective apexes and 2⅜" at the terminal ends of the cuts) which were removed from both sides of the tubular stock cut. The intact and uncut top wall section was then folded downwardly and abutted onto the sloped edge cuts of the respective sidewalls and welded together to provide the tapered section of elongated member 20.

The rigid rim section 30 was fabricated from a steel angle iron stock piece measuring ⅛" thick ×3" in length with one leg thereof forming the upwardly extending rim section 31 measuring 1½" in height and the other leg (resting perpendicularly thereto) forming an inwardly extending lip 32 measuring 1 inch. With lip 32 projecting inwardly towards the top wall of main beam, the rim section 30 was abutted against ⅝" terminal edges of the sidewall with the outer surface of rim section 31 resting at a supplemental angle of about 110 degrees in relationship to the bottom planar surface of the elongated base 20. The rim section 30 was then welded onto the terminating edges of the sidewalls and top wall to form a hooked rim section 30 rigidly and firmly secured onto the elongated base 20.

The slotted retaining plate 41 was then fabricated from a rectangular pre-cut steel plate (measuring ⅛" thick ×3" wide ×4¼" in length) by drilling a series of ½" dia. holes beginning 1" removed from one of its lengthwise ends along its longitudinal center line. The ½" diameter drill holes formed a centrally disposed and continuous slotted aperture measuring about 1½" in length. The irregular drill hole edges were then smoothed by grinding to form an elongated slotted aperture 42 measuring 9/16" in width and 1½" long. The rail base retaining unit 43 was then precut from a steel bar (⅜"×⅜"×3") and welded onto the bottom side of the plate which rests in closest proximity to the slotted aperture 42 at a recessed position ⅜" removed from the leading edge of the lengthwise cross cut of the plate to provide the adjustable and biasing engaging member 40 fitted with a slotted aperture 42 and rail retaining unit 43.

The means for biasing the adjustable rail engaging member 40 against the support member 20 and a rail was then rigidly secured onto the elongated member 20. A ½" diameter drill hole was drilled perpendicularly through the top and bottom walls of the tubular support member 20 at a centroid position and 8⅜" removed from the interfacial abuttment juncture of the rigid rim section 30 onto elongated member 20. A carriage bolt (½"×4") was then installed from the underside through the drill hole so that carriage bolt 57 threads projected upwardly from the top surface or wall section of base member 20. The carriage bolt 57 head was then welded directly onto the underside of support member 20 so as to prevent its dislodgement or turning when torquing the wing nut 51 thereupon. The slotted aperture 42 of the adjustable biasing plate 40 was then installed onto bolt 57 with the rail retaining unit 43 being positioned downwardly so as to rest upon the top surface or wall section of support member 20. A retaining washer 58 (½" I.D.×1¼" O.D.) was then placed onto the carriage bolt 57 to bridge across the elongated aperture 42 of biasing plate 41.

The extended wings 52 and 53 of wing nut 51 was then fabricated from flat steel plate stock (measuring ⅛" thick×1"×5") be drilling at its centroid a ½" drill hole. The padlock receiving apertures 54 and 55 were incorporated into wings 52 and 53 by drilling two ⅜" diameter holes into the flat steel stock leaving a ⅜" bordering end margin for each of the drill holes at opposite length ends of plate stock. The steel plate was then heated and concavularly bent upwardly so that each of the distal ends of the plate stock pitched upwardly by approximately ⅝" from the center drill hole which in turn provided two upwardly extending wings 52 and 53 with adequate clearance and for ease of torquing the wing nut 51. A ½" nut was then centered over the centroid drill hole on the bottom side of the concave handle and directly welded thereto to provide wing nut 51. The wing nut 51 was then threaded onto the ½" carriage bolt 57. A ¾" steel washer with ½" diameter bore was then positioned flushly onto the top threaded margin of the carriage bolt 57 and welded thereto to form wing nut stop section 59.

Mounting braces 22 and 23 were fabricated from flat steel plate stock measuring ⅛" thick×1" width×3" in length. Three 9/32" diameter drill holes horizontally aligned lengthwise along the centerline and spaced 1 inch apart from center to center of each drill hole with an adequate bordering margin for structural strength along the length ends were drilled into each of the plate stocks to form the three paired laterally registering apertures, 24 and 27, 25 and 28, 26 and 29. Mounts 22 and 23 were then laterally positioned one inch apart onto the top surface of the elongated supportive member 20 at a distance 3¾" removed from top wall access port 22 edge at a distance ½" removed from the longitudinal top wall centerline and welded directly onto member 20.

The pivotal signaling support arm 60 was fabricated from 1" square tubular steel stock of a 1/16" thick walls and 26" in length. Allowing for a ¼" margin from one end of the tubular 1" square stock, a 9/32" diameter drill hole was centered and perpendicularly bored through two of the laterally disposed sidewalls of the tubular stock to provide arm aperture 65 for corresponding registration onto pivotal apertures 25 and 26 of braces 22 and 23 which in conbination with mounting bolt 63 (measuring ¼" diameter×2½") permits arm 60 to be mounted and pivotally swing thereabout (180 degree arc). The latch pin aperture 66 was then formed by a bore centered along the tubular stock longitudinal center line in lateral and parallel alignment with aperture 65 (center of 65 and 66 laterally spaced 1" apart) so as to provide corresponding registration onto apertures 24 and 27 when arm 60 is positioned in the unextended position as shown in FIGS. 1–2 and 6 and for registration with aperture 26 and 29 when extended as illustrated in FIGS. 4–5 and 7.

Four standard pipe couplers (⅜" threaded internal diameter and 1¼" length) were then utilized to provide the signaling unit mounts 68, 69, 70 and 71. One pair of pipe couplers were abuttingly centered in vertical alignment upon the terminal end opposite from apertures 65 and 66 of the 1" square tubular steel and welded thereto to form mounts 68 and 69. The remaining two pipe couplers (which formed mounts 70 and 71) were respectively laterally and vertically positioned onto the opposite sides of the tubular steel stock sidewalls at a position 15 inches removed from mounts 68 and 69 (as measured from center to center) and welded onto the sidewalls. An arm securing chain comprised of two chain lengths was secured onto arm 60 by welding one of the chain length loop ends within the vertical recessed area between mounts 68 and 69 as depicted in FIGS. 1–2 and 5–6.

Commercially available fiberglass rods (manufactured and distributed by Worcester Brush Co., Worcester, Mass.) measuring 48"×⅜" diameter fitted on one end with ⅜" O.D. threaded male pipe threads and steel caps on the other end were used as flagging staffs 85 and 86. Each of the steel caps were removed from the rods and the rods were cut to an over-all length of 41 inches.

Two rubber hoses (e.g. 3/16" I.D.×4") were then forced onto each of the threaded male ends from the fiberglass rod cut side leaving about 1½" exposed margin (i.e. not covered by each hose) at the threaded end of each staff. The rubber hose inserts 89 and 90 impart structural strength to mounted staffs and also serve as thread stop to prevent further tightening of the staffs onto the mounting pipe couplers as well as forming a seating seal to protect the threaded components from rusting or accumulating dirt and other foreign debris. The steel caps (in the shape of open ended cylindrical couplers) were then securely reinstalled onto the respective ends of rods to serve as the open ended cylindrical couplers 91 and 92. A pair of 3/16" dia. holes were drilled through each of the head sections 93 and 94. A ⅛" dia.×16½" steel rod fitted at one end with a 3/16" terminating ball was installed through lever receiving apertures 95. One end of the steel rod was installed through aperture 95 so as to leave about ¾" of the rod margin projecting therefrom followed by bending of the rod to a right angle. The remaining portion of the rod projecting from opposite side of aperture 95 was likewise bent at a right angle in the same direction to provide flag support rod 101 of a J-shaped configuration which also allows it to function as leveraged fastening handle 97. The flag support rod 101 is designed to mate onto a laterally ¼" aligned dia. hole drilled in steel adapter 92 of the opposite fiberglass staff member 88, which when fitted therein forms a horizontal flag support and brace between the staffs 85 and 86. Fastening lever 98 was constructed of ⅛"×4½" steel rod stock inserted into aperture 96 and similarly bent into a J-shaped rod to prevent its dislodgment leaving a 3" protruding margin therefrom to afford sufficient leverage for the tightening of the staff onto a signal mount unit.

The flagging unit 81 was constructed of a reflectorized plastic material with a webbed plastic backing (each measuring 15½ inches wide×24" in height and distributed by Reflexite Corp., New Britian, Conn.), a webbed polyester band (7"×⅝"), two mating strips of VELCRO (measuring about 2½"×½"), two hooked VELCRO units (each measuring about 1½"×1 7/8") and two napped units (each measuring about 5½"× about 1"). The two VELCRO hooked units (face out) were sewn onto the back side of the backing by centering the respective hooked units within the flag at a distance ⅓ of total flag horizontal distance and about 1¾" removed from flag upper horizontal edge. The remaining hooked unit (measuring about 2½"×½") was centered along the vertical bisect of the flag with the ½" width edge abutting flushly against the flag's vertical edge and sewn to the backing with the hooked unit projecting outwardly therefrom. The reflectorized facing was then superimposed onto the backing and sewn together leaving about ⅜" inch margin between the top and bottom edges and a vertical margin about 2" removed from the vertical edges of the superimposed pieces. The webbed band (7"×⅝") with a VELCRO nap superimposed and sewn onto the band at a distance 1¼" removed from one band end was then placed in a perpendicular relationship to one of the vertical edges of the flag and sandwiched between the backing and flag by about ½" margin with the napped strap facingly aligned upwardly with the planar facing of the reflectorized flag facing. The two VELCRO napped units (5½"×1") were vertically aligned with the corresponding hooked units (nap facing rearwardly) so that about a ¾" lengthwise portion thereof was interposed between the flag and backing and remaining length thereof (about 4¾") projecting in a perpendicular relationship to the upper horizontal edges of the superimposed flag and backing. At about a ⅜" distance removed from the horizontal and vertical edges of the backing and the flag assembly (including the backing, flag and interposed napped units therebetween) were then sewn together. The open ended double vertical stitches along the outer vertical margins of the backing and reflectorized flag form the pair of sleeves (82 and 83) for the vertical housing of staffs 87 and 88. The reflectorized flag 81 may be accordingly rolled onto and secured to the staff opposite from the hooked tab unit 85A for stowage and releasable detached therefrom for use. The two VELCRO napped and hooked units along the upper margin afford a detachable means for securing and supporting the flag unit 1 onto support rod 101.

As evident from the aforementioned, the present invention also provides a method for securely installing a portable signaling device equipped with a supportive elongated base member and a detachable signal unit supported by the base member onto a base of a railroad rail, said method comprising:

(a) adjusting a clamping mechanism secured to said base member so as to interfacially clasp onto the base of a railroad rail; and (b) applying a sufficient mechanical clamping force onto the clamping mechanism so as to securely bias and wedge the base of a railroad base between said clamping mechanism, and thereby providing a portable signaling device securely installed onto the base of a railroad rail.

What is claimed is:

1. A portable railroad signaling device which may be secured onto a rail base to provide a temporary signaling device for railway personnel, said device comprising:

(a) an elongated supportive base member;

(b) a first rail base engaging section secured to said base member, with said first section being of a size and configuration sufficient to interfacially engage and register onto a first vertical extending portion of the rail base;

(c) an adjustable rail engaging section comprised of a retaining plate having a rail engaging unit affixed to said plate for interfacially engaging onto a second portion of the rail base opposite from said first rail base engaging section with said plate interfacially contacting upon said base member and radially projecting upwardly therefrom onto said unit;

(d) mechanical means for applying a biasing force onto said plate so that when said biasing force is applied onto said plate said biasing force with bias said plate downwardly and inwardly against said second portion and towards said first section and thereby firmly wedge and rail base therebetween;

(e) a detachable signaling unit and means for mounting said detachable signaling unit onto said elongated base member;

wherein the signaling unit mounting means includes a flag support arm fitted with a mount for the signaling unit with said arm being pivotally mounted onto said elongated base member so as to afford a plurality of variable flagging positions for a signaling unit mounted onto said arm.

2. The device according to claim 1 wherein the first rail base engaging section comprises a rigid rim section for interfacial engagement and registration onto a first shouldered portion of the rail base.

3. The device according to claim 1 wherein the adjustable rail engaging section is provided with means of slideably engaging onto an opposing sidewall shouldered portion of the rail base from said first rail engaging section.

4. The device according to claim 2 wherein the mechanical means includes means for directionally applying onto the adjustable engaging section a downwardly and inwardly biasing force towards said rim section.

5. A portable flagging device for temporarily warning rail personnel of rail conditions with comprises:

(a) a horizontal main beam;

(b) a flanged hooked member projecting upwardly from said beam for matingly engaging onto a first side of a rail base;

(c) an adjustable rail engaging member adjustably secured onto said beam for operative engagement onto an opposing side of the rail base from said hooked member, with said engaging member upon operative engagement onto said opposing side resting upon said beam and radially projecting upwardly therefrom onto said opposing side;

(d) mechanical means for applying a biasing force onto said adjustable member so as to bias the engaging member downwardly and inwardly against said opposing side and towards said flanged member, and thereby firmly bias the rail base between said adjustable rail engaging member and the flanged hooked member; and (e) a signaling unit and means for mounting said signaling unit onto said beam;

wherein the signaling unit mounting means includes a flag support arm fitted with a mount for the signaling unit with said arm being pivotally mounted onto said beam so as to afford a plurality of variable flagging positions for a signaling unit mounted onto said arm.

6. The device according to claim 5 wherein the adjustable engaging member comprises a substantially flat retaining plate having a flanged projection affixed thereto at a recessed position sufficiently removed from a leading edge of the plate so as to provide a recessed anchoring site for interfacial engagement onto an opposing side shoulder portion of the rail base from said hooked member, and one end of the plate interfacially rests upon the beam and the plate radially projects upwardly therefrom.

7. The device according to claim 6 wherein the retaining plate includes a slotted aperture for adjustably placing the flanged projection onto the opposing side shoulder portion and the mechanical means comprises a mechanical torque means for torquing the retaining plate against the opposing side shoulder portion in a downwardly and inwardly direction towards said hooked member.

8. The device according to claim 5 wherein the mechanical means comprises torquing means for directionally biasing the adjustable rail engaging member against the opposing side shoulder portion of the railroad rail base and towards said hooked member so as to thereby firmly wedge the rail base between said hooked member and said adjustable engaging member.

9. The device according to claim 8 wherein the mechanical means in cooperative association with said beam, said flanged hooked member and said adjustable rail engaging member transmits a radially biasing force of at least 200 pounds per square inch against the rail base and towards said hooked member.

10. The device according to claim 9 wherein the mechanical means for firmly biasing the rail base includes a means for locking the mechanical means at a firmly biasing position and to thereby inhibit the disengagement of the biasing force therefrom.

11. The device according to claim 8 wherein the portable flagging device includes a housing for stowing a detachable signal unit and an extendable arm pivotally mounted onto the base member for the mounting of the detachable signal unit thereupon.

12. The device according to claim 11 wherein the horizontal main beam includes the housing for the stowing of the detachable signaling unit therewithin.

* * * * *